US008129017B2

(12) United States Patent
Yoshikawa et al.

(10) Patent No.: US 8,129,017 B2
(45) **Date of Patent: *Mar. 6, 2012**

(54) CARBON FIBER STRAND AND PROCESS FOR PRODUCING THE SAME

(75) Inventors: Hidekazu Yoshikawa, Shizuoka (JP); Taro Oyama, Shizuoka (JP); Hiroshi Kimura, Shizuoka (JP)

(73) Assignee: Toho Tenax Co., Ltd., Tokyo (JP)

( * ) Notice: Subject to any disclaimer, the term of this patent is extended or adjusted under 35 U.S.C. 154(b) by 44 days.

This patent is subject to a terminal disclaimer.

(21) Appl. No.: 12/740,043

(22) PCT Filed: Oct. 31, 2008

(86) PCT No.: PCT/JP2008/069852

§ 371 (c)(1),
(2), (4) Date: Apr. 27, 2010

(87) PCT Pub. No.: WO2009/060793

PCT Pub. Date: May 14, 2009

(65) Prior Publication Data

US 2010/0252439 A1 Oct. 7, 2010

(30) Foreign Application Priority Data

Nov. 6, 2007 (JP) ..... 2007-288170

(51) Int. Cl.
*B32B 9/00* (2006.01)

(52) U.S. Cl. ..... 428/367; 423/447.1; 205/50

(58) Field of Classification Search ..... 428/367; 423/447.1, 447.2; 205/50, 159
See application file for complete search history.

(56) References Cited

U.S. PATENT DOCUMENTS

| | | | | |
|---|---|---|---|---|
| 5,078,840 | A * | 1/1992 | Ogawa et al. | 205/768 |
| 5,356,707 | A * | 10/1994 | McCullough et al. | 428/367 |
| 5,582,912 | A * | 12/1996 | McCullough et al. | 428/367 |
| 6,221,490 | B1 * | 4/2001 | Matsuhisa et al. | 428/367 |
| 7,638,110 | B1 * | 12/2009 | Yoshikawa et al. | 423/447.2 |
| 2005/0271874 | A1 * | 12/2005 | Sakajiri et al. | 428/364 |
| 2010/0252438 | A1 * | 10/2010 | Yoshikawa et al. | 205/50 |

(Continued)

FOREIGN PATENT DOCUMENTS

JP 1025627 A 1/1989

(Continued)

*Primary Examiner* — N. Edwards
(74) *Attorney, Agent, or Firm* — Norris McLauglin & Marcus P.A.

(57) ABSTRACT

A carbon fiber strand obtained by bundling 20,000-30,000 carbon fibers each having, in the surface thereof, creases which are parallel to the fiber-axis direction. In an examination with a scanning probe microscope, the creases in the carbon fiber surface are apart from each other at a distance of 120-160 nm and have a depth of 12-23 nm, excluding 23 nm. The carbon fibers have an average fiber diameter of 4.5-6.5 nm, specific surface area of 0.9-2.3 $m^2/g$, and density of 1.76 $g/cm^3$ or higher. The carbon strand has a tensile strength of 5,900 MPa or higher and a tensile modulus of 300 GPa or higher. When would on a bobbin at a tension of 9.8 N, the strand on the bobbin has a width of 5.5 mm or larger. When the carbon fiber strand is examined by a strand splitting evaluation method in which the strand is caused to run through three stainless-steel rods while applying a tension of 9.8 N thereto, no strand splitting is observed.

3 Claims, 7 Drawing Sheets

U.S. PATENT DOCUMENTS

2010/0252439 A1* 10/2010 Yoshikawa et al. ..... 205/50

FOREIGN PATENT DOCUMENTS

| | | | |
|---|---|---|---|
| JP | 2530767 | B2 | 9/1996 |
| JP | 02327339 | A | 11/2002 |
| JP | 2003064539 | A | 3/2003 |
| JP | 2003306836 | A | 10/2003 |
| JP | 2004107836 | A | 4/2004 |
| JP | 2004285501 | A | 10/2004 |
| JP | 2005133274 | A | 5/2005 |
| JP | 2005314830 | A | 11/2005 |
| JP | 2006183173 | A | 7/2006 |
| JP | 2007177368 | A | 7/2007 |
| WO | 2005078173 | A1 | 8/2005 |

* cited by examiner

CARBON FIBER STRAND AND PROCESS FOR PRODUCING THE SAME

TECHNICAL FIELD

The present invention relates to a carbon fiber strand as a bundle of 20,000 or more single fibers, and a manufacturing process therefor. The carbon fiber strand has a feature that the strand is resistant to splitting into a plurality of strands during fiber opening.

BACKGROUND ART

Carbon fibers are generally produced by a well-known process where raw fibers (precursor fibers) such as polyacrylonitrile (PAN) are oxidized and carbonized to give carbon fibers. The carbon fibers thus obtained have excellent properties such as high strength and high elastic modulus.

Composite materials (for example, carbon fiber reinforced plastic (CFRP)) produced utilizing carbon fibers have been used for increasing applications. For example, in the fields of sports/leisure, aerospace and automobiles, (1) improved performance (improvement in strength and elasticity) and (2) weight reduction (weight reduction of fibers and reduction of a fiber content) have been required in a composite material. For meeting these requirements, there has been needed carbon fibers as a composite material produced by combining carbon fibers and a resin (matrix material), which exhibits improved physical properties.

For providing a high-performance composite material, physical properties of the matrix material are important. Improving the surface properties, strength and an elastic modulus of carbon fibers is also important. Generally, it is important to combine a matrix material and carbon fibers having a carbon fiber surface exhibiting high adhesiveness to the matrix material, and to adequately uniformly disperse the carbon fibers in the matrix material. Thus, a higher-performance composite material can be provided.

There have been investigations for surface crease, surface properties, strength and an elastic modulus of carbon fibers (for example, see Patent References Nos. 1 to 4).

In producing carbon fibers, a spinneret having more spinning holes is more suitable for large-scale production. However, a precursor fiber strand produced by spinning from a spinneret having 20,000 or more spinning holes has higher fiber-opening tendency. Therefore, when a carbon fiber strand is produced using such a precursor fiber strand as a raw material, fiber opening excessively proceeds during the oxidation and the carbonization steps described later to provide a carbon fiber strand exhibiting inconsistent physical properties.

For controlling an extent of fiber opening, a large amount of a sizing agent may be added. In such a case, particularly in the carbonization step, there generate a large amount of impurities derived from the sizing agent, which adversely affect the physical properties of carbon fibers produced. Consequently, a carbon fiber strand obtained exhibits significant uneven strength, so that a carbon fiber strand with high strength and a high elastic modulus cannot be provided.

To avoid the above problems, there is proposed a process for producing a precursor strand consisting of 20,000 or more single fibers by bundling a plurality of precursor strands spun using a spinneret having a relatively smaller number of spinning holes.

An example is thought of production of a carbon fiber strand as a bundle of 24,000 single fibers. Generally, a precursor strand consisting of 3,000 to 12,000 single fibers can be provided using one spinneret. Two to eight of the precursor strands can be bundled to provide a precursor strand consisting of 24,000 single fibers, which can be then oxidized and carbonized to give a carbon fiber strand consisting of 24,000 single fibers. Alternatively, each of the precursor strands can be directly oxidized and then, the individual strands can be bundled during the subsequent carbonization to give a carbon fiber strand consisting of 24,000 single fibers. Alternatively, each of the precursor strands can be directly oxidized and then carbonized before bundling the individual strands to give a carbon fiber strand consisting of 24,000 single fibers.

However, when a composite material is produced using carbon fiber strands prepared as described above, fiber opening of the bundled carbon fiber strands for resin impregnation substantially causes separation of these into the original strands, so-called strand splitting.

Since each carbon fiber constituting a bundled strand is not prepared from a single spinneret, its properties such as strength tends to significantly vary.

As described above, in a carbon fiber strand consisting of 20,000 or more single fibers prepared by collecting a plurality of strands, strand splitting tends to occur during fiber opening and physical properties of each carbon fiber constituting a strand are inconsistent. Furthermore, since physical properties of each carbon fiber constituting a strand are inconsistent, a strand tensile strength and a strand tensile modulus of the carbon fiber are generally low.

Generally, for producing a composite material, a carbon fiber strand is adequately fiber-opened and then, uniformly impregnated with a matrix resin. When strand splitting occurs during fiber opening of the carbon fiber strand, impregnation with the resin becomes uneven, leading to deterioration in physical properties of the composite material obtained. Therefore, the feature required for a carbon fiber strand suitable for manufacturing a composite material is adequate fiber opening without causing strand splitting.

Patent Reference No. 1: Japanese published unexamined application No. 1998-25627 (Claims).

Patent Reference No. 2: Japanese published unexamined application No. 2006-183173 (Claims).

Patent Reference No. 3: Japanese published unexamined application No. 2005-133274 (Claims).

Patent Reference No. 4: Japanese published unexamined application No. 2002-327339 (Claims).

DISCLOSURE OF INVENTION

Technical Problem

The inventors have intensely conducted investigation for solving the above problems. Finally, we have conceive a process where a precursor fiber strand prepared using spinnerets having 20,000 or more spinning holes per one spinneret is interlaced under predetermined conditions and then undergoes predetermined oxidation and carbonization and surface oxidation under particular conditions. This process can provide a carbon fiber strand which is easily fiber-opened while being resistant to strand splitting. As a result of the above investigation, the present invention has been achieved.

Therefore, an objective of the present invention is to provide a carbon fiber strand in which the above problems are solved and a production process therefor.

Technical Solution

The present invention which can achieve the above objective has the following aspects.

[1] A carbon fiber strand comprising of a bundle of 20,000 to 30,000 carbon fibers, each of which has in the surface thereof, a plurality of creases parallel to the fiber-axis direction of the carbon fiber and in which as measured by scanning probe microscopy, an inter-crease distance in the surface of said carbon fiber is 120 to 160 nm, a crease depth in the surface is 12 to less than 23 nm, an average fiber diameter is 4.5 to 6.5 μm, a specific surface area is 0.9 to 2.3 $m^2/g$ and a density is 1.76 $g/cm^3$ or more, wherein said carbon strand has a strand tensile strength of 5,900 MPa or more and a strand tensile modulus of 300 GPa or more; a strand wound on a bobbin with a tension of 9.8 N has a strand width of 5.5 mm or more; and no strand splittings are observed in a strand splitting evaluation method where a running carbon fiber strand with a tension of 9.8 N passes through three stainless-steel rods.

[2] A process for producing the carbon fiber strand as described in [1], comprising passing a solidified-yarn strand prepared by spinning a stock spinning solution using a spinneret having 20,000 to 30,000 spinning holes through an interlacing nozzle at a pressurized-air blowing pressure of 20 to 60 kPa as a gauge pressure to provide a precursor fiber strand; then oxidizing said precursor fiber strand in hot air at 200 to 280° C. to provide an oxidized fiber strand; conducting first carbonization by stretching said oxidized fiber strand with a first stretch ratio of 1.03 to 1.06 at a temperature of 300 to 900° C. in an inert-gas atmosphere and then with a second stretch ratio of 0.9 to 1.01 (second stretching); then, conducting second carbonization at a temperature of 1,360 to 2,100° C. in an inert-gas atmosphere; and then, oxidizing twice or more the surface of the carbon fiber strand obtained after said carbonization, by electrolytic oxidation in an electrolytic solution with a pH of 0 to 5.5, a oxidation-reduction potential of +400 mV or more and a product of a pH and a oxidation-reduction potential of 0 to 2,300.

[3] The process for producing a carbon fiber strand as described in [2], wherein said stock spinning solution is an aqueous solution of zinc chloride or a solution of an acrylic polymer in an organic solvent.

ADVANTAGEOUS EFFECT

The carbon fiber strand of the present invention is produced using a precursor strand derived from a single spinneret, so that it is resistant to strand splitting during fiber opening in spite of the fact that it consists of 20,000 or more single fibers. Therefore, in producing a composite material, the strand can be largely opened to be impregnated with a resin. As a result, a composite material having good physical properties can be prepared. Furthermore, since each single fiber in the carbon fiber strand is prepared using a single spinneret, variation in physical properties is small between the single fibers. Thus, a strand tensile strength and a strand tensile modulus of the carbon fiber strand are higher than those for a conventional carbon fiber strand consisting of 20,000 or more single fibers prepared by bundling a plurality of strands.

Each carbon fiber constituting the carbon fiber strand has an inter-surface-crease distance, a depth and a specific surface area within predetermined ranges, and therefore, exhibits good adhesiveness to a matrix resin. Therefore, by using the carbon fiber strand of the invention, there can be produced a composite material having improved composite material physical properties such as a high compressive elastic modulus and a high tensile strength, which are particularly required in aerospace applications.

The process for producing a carbon fiber strand of the present invention is suitable for a large-scale production because a precursor fiber strand can be formed using a spinneret having 20,000 or more spinning holes in one process.

EXPLANATION OF REFERENCE

Figure 1:
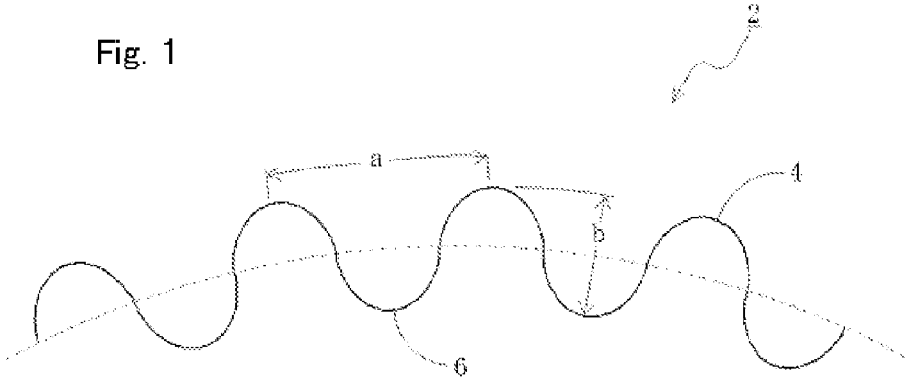
FIG. 1 is a schematic partial cross sectional view illustrating an example of a carbon fiber filament constituting a carbon fiber strand of the present invention.

2: carbon fiber, 4: peak in a waveform, 6: trough in a waveform, a: inter-peak distance (inter-crease distance), b: difference in height between a peak and a trough (crease depth), 12: interlacing nozzle, 14: precursor fiber, 16: pressurized-air inlet, 18: pressurized-air, and 20: air flow.

BEST MODE FOR CARRYING OUT THE INVENTION

There will be detailed the present invention.

A carbon fiber strand of the present invention consists of a collection of 20,000 to 30,000, preferably 20,000 to 26000 single fibers (carbon fibers).

A strand tensile strength of this carbon fiber is 5,900 MPa or more, preferably 5,970 MPa or more. The upper limit is generally, but not limited to, about 6,500 MPa.

A strand tensile modulus of this carbon fiber is 300 GPa or more, preferably 308 to 370 GPa. Herein, sometimes, a strand tensile strength of a carbon fiber is simply called "strength", and a strand tensile modulus of a carbon fiber is simply called "elastic modulus".

This carbon fiber strand has a strand width of 5.5 mm or more, preferably 6 to 10 mm, more preferably 6 to 8 mm as determined by a strand width measuring method described below. This strand width is a value obtained by directly measuring a strand width on a bobbin wound with a tension of 9.8 N.

Furthermore, in this carbon fiber strand, no strand splittings are observed in a strand splitting evaluation method described below.

In the surfaces of the carbon fibers (single fibers) constituting a carbon fiber strand of the present invention, there are formed a plurality of creases in the same direction as a fiber-axis direction.

A specific surface area of a carbon fiber as determined by the measuring method described below is 0.9 to 2.3 $m^2/g$.

A density of a carbon fiber is 1.76 $g/cm^3$ or more, preferably 1.76 to 1.80 $g/cm^3$.

An average diameter of a carbon fiber is preferably 4.5 to 6.5 μm, more preferably 5.0 to 6.0 μm.

FIG. 1 is a partial cross sectional view illustrating an example of a carbon fiber constituting a carbon fiber strand of the present invention.

FIG. 1 shows a cross section of a carbon fiber taken on a plane perpendicular to a carbon fiber axis. The surface of a carbon fiber 2 of this example has a crease formed by fluctuation in a carbon fiber diameter along the circumferential direction of the fiber. In FIG. 1, "4" indicates a peak having a larger diameter. Then, "6" is a trough having a smaller diameter.

Then, "a" indicates an inter-peak distance (crease distance). Then, "b" indicates a difference in height between a peak and a trough (crease depth). A crease distance "a" and a crease depth "b" can be determined by scanning probe microscopy. Scanning probe microscopic observation of the surface of a carbon fiber indicates a crease distance "a"=120 to 160 nm and a surface crease depth "b"=12 to less than 23 nm.

A carbon fiber strand of the present invention can be prepared, for example, by the following method.

Stock Spinning Solution

A starting material for producing a carbon fiber strand of the present invention is a stock spinning solution for producing a precursor fiber. A stock spinning solution can be any known stock spinning solution for producing a carbon fiber without any restriction. Among them, preferred is a stock spinning solution for producing an acrylic carbon fiber. Specifically, preferred is a stock spinning solution prepared by homopolymerizing an acrylonitrile monomer or copolymerizing an acrylonitrile in 90% by weight or more, preferably 95% by weight or more with other monomers. Examples of another monomer which is copolymerized with acrylonitrile include acrylic acid, methyl acrylate, itaconic acid, methyl methacrylate and acrylamide.

A stock spinning solution is preferably an aqueous solution of zinc chloride or a 5 to 20% by weight solution of the above acrylonitrile polymer in an organic solvent such as dimethylformamide (DMF) and N,N-dimethylacetamide (DMAc).

Spinning

A stock spinning solution is ejected from a spinneret having 20,000 to 30,000, preferably 20,000 to 26000 spinning holes per spinneret. A stock spinning solution ejected from a spinning hole can be solidified by different various known methods such as wet spinning, dry-wet spinning and dry spinning. By employing such a spinning method, a stock spinning solution is solidified to give a solidified yarn.

Wet spinning is a method where a spinneret is immersed in a solidification liquid (a mixture of a solvent and water used in producing a stock spinning solution) cooled to a low temperature in a solidification bath and the stock spinning solution is directly ejected from the spinneret into the solidification bath. Dry-wet spinning is a method where first, a stock spinning solution is ejected from a spinneret to the air, passes through an about 3 to 5 mm space and is then fed to a solidification bath.

By wet spinning, a fine crease is spontaneously formed in the surface of the carbon fiber obtained finally. A crease distance and a surface crease depth can be adjusted by selecting the spinning conditions. The presence of such a crease can be expected to improved adhesiveness of a carbon fiber to a resin in producing a composite material. A spinning method is, therefore, preferably wet spinning. Here, the spinning hole generally has a perfect circular shape. In dry spinning, a crease can be formed, for example, by modifying the shape of the spinning hole or adjusting the spinning conditions. Furthermore, a crease distance, a surface crease depth and the like can be adjusted, depending on the surface oxidation conditions described below.

Then, the solidified yarn is appropriately subjected to common processing such as washing with water, drying and stretching.

In the above spinning step, it is preferable to add an oil to an acrylic fiber or the like for improving heat resistance and/or stable spinning. The oil is preferably a known oil as a combination of a permeable oil having a hydrophilic group and a silicone oil.

Interlacing

In the spinning step, tangling (entanglement) occurs between a number of solidified yarns constituting a solidified-yarn strand or temporal adhesion occurs due to an oiling. Furthermore, excessive fiber opening may occur. These lead to generation of fluff and breakage of a solidified yarn. To avoid these problems, interlacing is conducted. Interlacing partially detangles a solidified-yarn strand, achieving appropriate entanglement before fiber opening.

Figure 2:
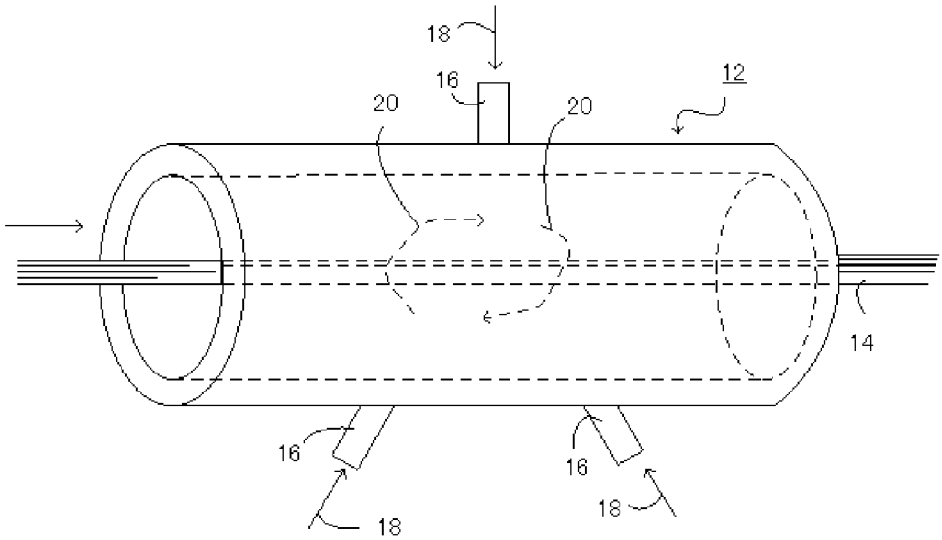
FIG. 2 is a conceptual view illustrating an example of an interlacing nozzle used in a process for producing a carbon fiber strand of the present invention.

Interlacing is conducted by letting a solidified-yarn strand pass through an interlacing nozzle, for example, shown in FIG. 2.

In FIG. 2, "12" is an interlacing nozzle. A solidified-yarn strand 14 passes through the inside of a cylindrical main body 12*a* constituting the interlacing nozzle 12. The interlacing nozzle 12 has a plurality of (three in this figure) pressurized-air inlets 16 penetrating the cylindrical main body 12*a*. Pressurized-air 18 is fed into the cylindrical main body 12*a* through the pressurized-air inlets 16. The pressurized-air fed generates air flow 20 within the cylindrical main body 12*a*. A pressurized-air blowing pressure is kept at 20 to 60 kPa as a gauge pressure.

When the pressurized-air blowing pressure is less than 20 kPa, entanglement between solidified-yarns in the solidified-yarn strand generated during the spinning step is eliminated and the solidified-yarn strand is fiber-opened.

When an inner pressure is 20 to 60 kPa, fiber opening and entanglement occur in a proper degree, resulting in improvement in convergence of a solidified-yarn strand.

A pressurized-air blowing pressure of more than 60 kPa leads to excessive entanglement in a solidified-yarn strand, resulting in damage to the solidified yarn and finally deterioration in strand strength. In this interlacing, a pressurized-air blowing pressure is adjusted within the proper range described above (20 to 60 kPa as a gauge pressure), to achieve proper fiber opening and entanglement in a strand without an damage in fibers.

By the above interlacing, a precursor fiber strand used in the method of the present invention is provided.

Oxidation

The precursor fibers thus interlaced are oxidized in hot air at 200 to 280° C. This oxidation causes, when a precursor fiber is an acrylic fiber, an intra-molecular cyclization reaction, resulting in increase in an oxygen binding amount in the acrylic fiber. As a result, these reactions provide acrylic oxidized fibers (OPF) in which acrylic fibers are made melting resistant and flame retardant.

In oxidation, precursor fibers are generally stretched with a stretch ratio of 0.85 to 1.30. For providing a carbon fiber with high strength and high elastic modulus, a stretch ratio is preferably 0.95 or more. The above oxidation provides oxidized fibers with a fiber density of 1.3 to 1.5 g/cm$^3$. A tension applied to the precursor fibers during oxidation is such that a stretch ratio is within the above range.

First Carbonization

The above oxidized fibers are carbonized in the first carbonization step. In the first carbonization step, the oxidized fibers undergo, in an inert atmosphere, the first stretching with a stretch ratio of 1.03 to 1.06 while being heated within a temperature range of 300 to 900° C. Then, they undergo the second stretching with a stretch ratio of 0.9 to 1.01 while a temperature rises. This stretching provides first-carbonized fibers with a fiber density of 1.50 to 1.70 g/cm$^3$.

First Stretching in the First Carbonization Step

The first stretching in the first carbonization step is initiated, under temperature rising, within the temperature range from the point where an elastic modulus of the oxidized fibers is reduced to a minimal value to the point where an elastic modulus increases to 9.8 GPa, to the point where a density of the fibers reaches 1.5 g/cm$^3$ and to the point where a crystallite size of the fibers reaches 1.45 nm as determined by wide-angle X-ray measurement (diffraction angle: 26)°.

Figure 3:
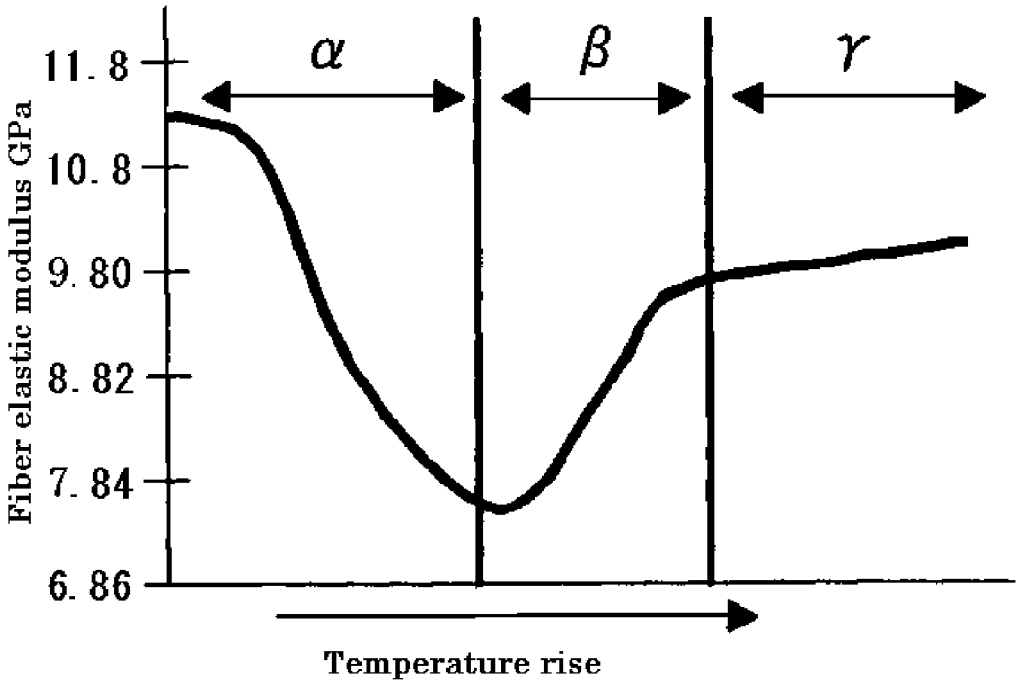
FIG. 3 is a graph showing change of an elastic modulus in PAN oxidized fibers to temperature increase during the first stretching in the first carbonization step.

The temperature range from the point where an elastic modulus of the oxidized fibers is reduced to a minimal value to the point where an elastic modulus increases to 9.8 GPa is indicated as "β" in FIG. 3.

By the stretching within the range from the point where an elastic modulus of the oxidized fibers is reduced to a minimal value to the point where an elastic modulus increases to 9.8 GPa, a part with a low elastic modulus in the oxidized fiber is efficiently stretched while yarn break is prevented. Furthermore, during this stretching, the fibers are highly oriented, resulting in dense first-stretched fibers.

If the stretching is initiated with the above stretch ratio before an elastic modulus of the oxidized fibers is reduced to a minimum value (the range of "α"), yarn break increases, undesirably leading to significant deterioration in strength of the carbon fibers obtained.

If an elastic modulus of the oxidized fibers is reduced to a minimal value and then the stretching is initiated with the above stretch ratio after the elastic modulus reaches 9.8 GPa (the range "γ"), the oxidized fibers have a high elastic modulus, leading to forced stretching. As a result, defects and voids in the fibers increase. Thus, the first stretching is conducted within the above elastic modulus range.

By stretching the oxidized fibers within the range to the point where a density of the oxidized fibers reaches 1.5 g/cm$^3$, orientation can be improved while preventing void formation, resulting in high-quality first-stretched fibers.

If the first stretching is conducted with the above stretch ratio within the range where a density of the oxidized fibers is more than 1.5 g/cm$^3$, the oxidized fibers are forcibly stretched, leading to increase in void formation. In such a case, the finally obtained carbon fibers have a structural defect and a low density.

If a stretch ratio of the oxidized fibers during the first stretching is less than 1.03, the oxidized fibers are inadequately oriented. Consequently, high-strength carbon fibers cannot be obtained. On the other hand, if the stretch ratio is more than 1.06, yarn break occurs and thus high-quality/high-strength carbon fibers cannot be obtained.

Second Stretching in the First Carbonization Step

Figure 4:
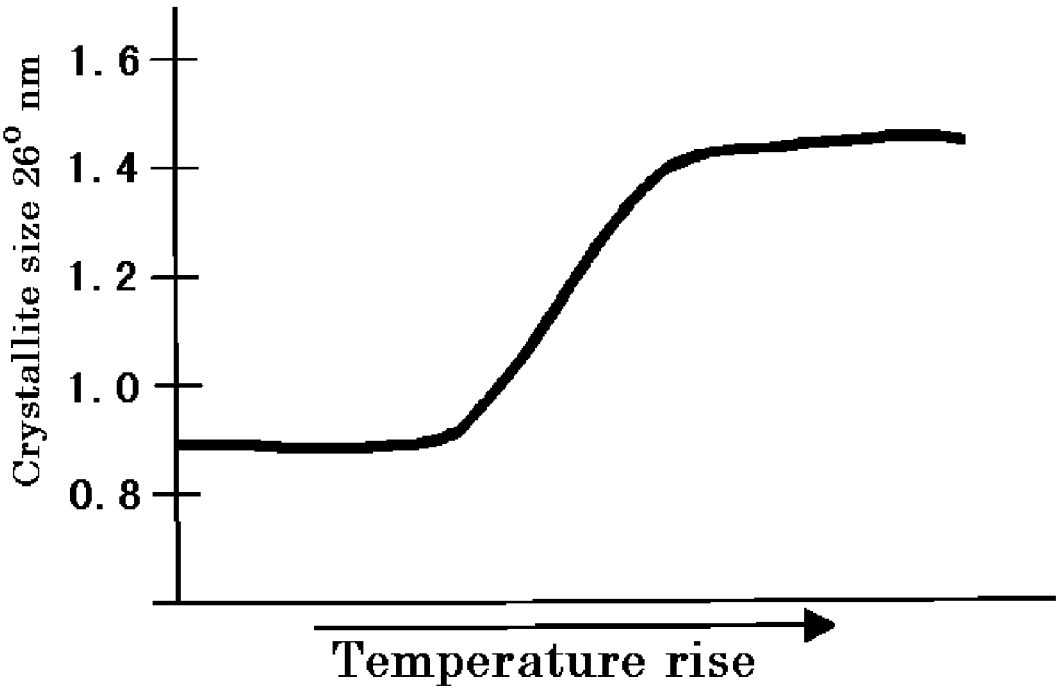
FIG. 4 is a graph showing change of a crystallite size in PAN oxidized fibers to temperature increase during the first stretching in the first carbonization step.

In the second stretching in the first carbonization, the fibers after the first stretching undergo the second stretching with a stretch ratio of 0.9 to 1.01. Stretching is conducted, under temperature rising, within the range where a fiber density after the first stretching continues to increase during the second stretching and where as shown in FIG. 4, a crystallite size of the fibers after the first stretching is 1.45 nm or less.

A crystallite size is a measured value as determined by wide-angle X-ray measurement (diffraction angle: 26°).

Figure 5:
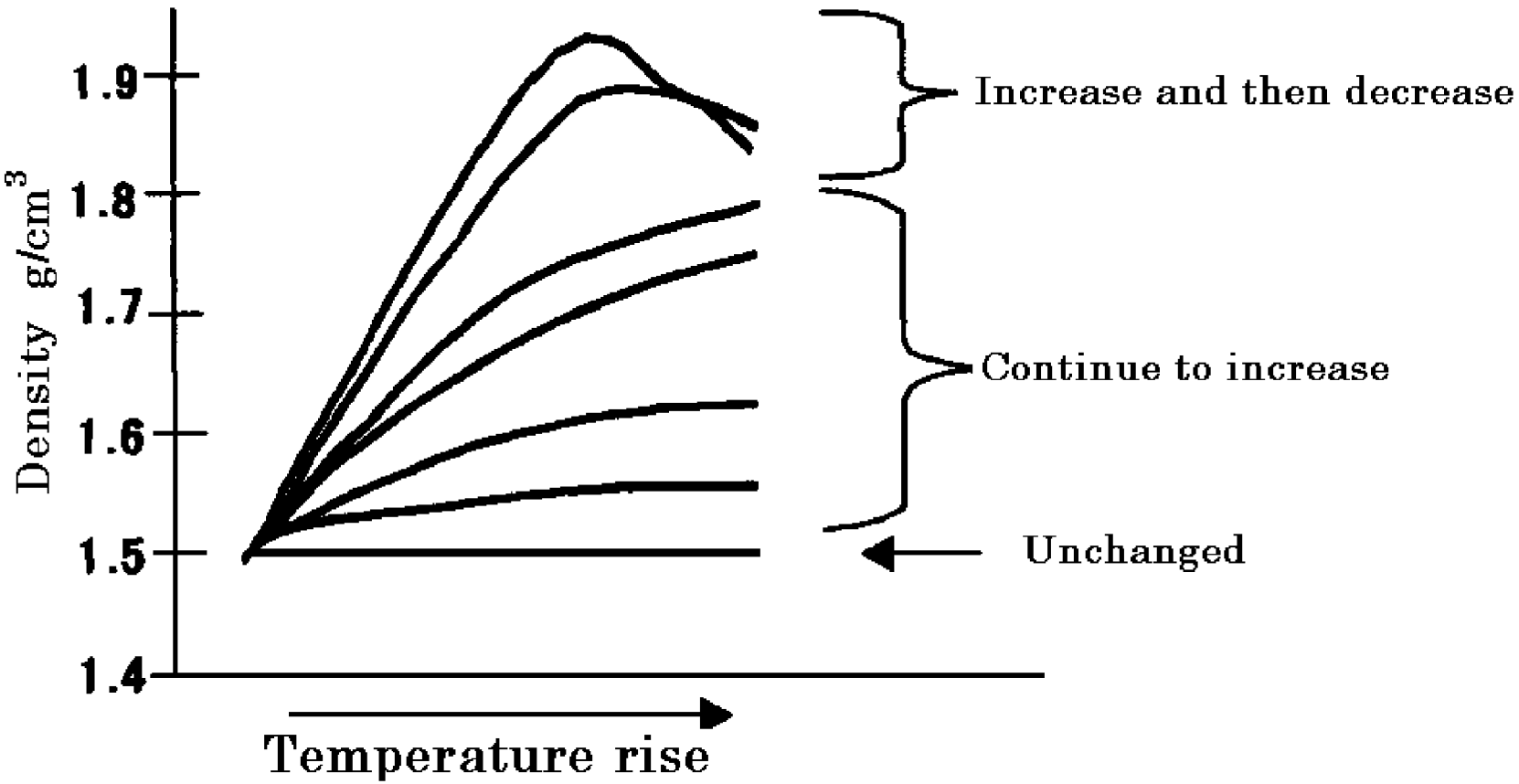
FIG. 5 is a graph showing change in a density of the first-stretched fiber to temperature increase during the second stretching in the first carbonization step.

When a stretching temperature is increasing during the second stretching step, there appear the conditions in which a density of the fibers after the first stretching is unchanged (not increase), the conditions in which it continues to increase, and the conditions in which it increases and then decreases (the conditions in which a fiber density decreases during the second stretching) as shown in FIG. 5.

Among these conditions, under the conditions in which a density of the fibers after the first stretching continues to increase during the second stretching, stretching can be conducted with a stretch ratio of 0.9 to 1.01 to prevent void formation and finally to provide dense carbon fibers. The conditions in which the density continues to increase do not include the range where the density is unchanged and the range where the density temporarily decrease.

Decrease of a fiber density during the second stretching indicates void formation. In this case, a dense carbon fiber cannot be obtained. The presence of the range where a fiber density is unchanged during the second stretching indicates insufficient orientation and densification state. Thus, the second stretching is the range where the fiber density continues to increase.

By the stretching with a stretch ratio of 0.9 to 1.01 within the range where a crystallite size of the fibers after the first stretching is 1.45 nm or less, densification occurs without crystal growth. Furthermore, void formation can be prevented to finally provide carbon fibers having improved denseness.

A crystallite size is increased by high-temperature stretching. If the second stretching is conducted within the temperature range where a crystallite size increases more than 1.45 nm, void formation in the fibers is accelerated. Furthermore, yarn break occurs, resulting in deterioration in fiber quality. Consequently, high-strength carbon fibers cannot be provided. Therefore, the second stretching is conducted within the above crystallite size range.

If a stretch ratio is less than 0.9 in the second stretching, fiber orientation is significantly deteriorated. As a result, high-strength carbon fibers cannot be obtained.

If a stretch ratio is more than 1.01, yarn break occurs during the stretching, so that high-quality and high-strength carbon fibers cannot be obtained. Therefore, a stretch ratio is within the range of 0.9 to 1.01 during the second stretching.

For providing high-strength carbon fibers, the first-carbonized fibers preferably have an orientation degree of 76.0% or more as determined by wide-angle X-ray measurement (diffraction angle: 26°).

If the orientation degree is less than 76.0%, high-strength carbon fibers cannot be provided.

As described above, the oxidized fibers in the first carbonization step undergo the first stretching and the second stretching to provide the first-carbonized fibers.

In the first carbonization step, carbonization may be conducted using one oven. Alternatively, the carbonization can be conducted in a series of processes using two or more ovens. Alternatively, the carbonization can be conducted in separate steps.

Second Carbonization

In the second carbonization, the first-carbonized fibers obtained by the above method are stretched under an inert atmosphere at a temperature of 1,360 to 2,100° C. with a stretch ratio of 0.9 to 1.01, to provide second-carbonization fibers. This step can be, if necessary, divided into a first and a second stretching steps.

Furthermore, for making the obtained carbon fibers have a required elastic modulus, a third carbonization step may be, if necessary, conducted after the second stretching in the second carbonization step for heating the carbon fiber strands.

In the second carbonization step, carbonization may be conducted using one oven. Alternatively, the carbonization can be conducted in a series of steps using two or more ovens. Alternatively, the carbonization can be conducted in separate steps.

First Stretching in the Second Carbonization Step

In the second carbonization step, the first-carbonized fibers are stretched within the range where a density of the fibers continues to increase, where a nitrogen content of the fibers is kept at 10% by weight or more and where a crystallite size of the fibers is 1.47 nm or less.

Figure 6:
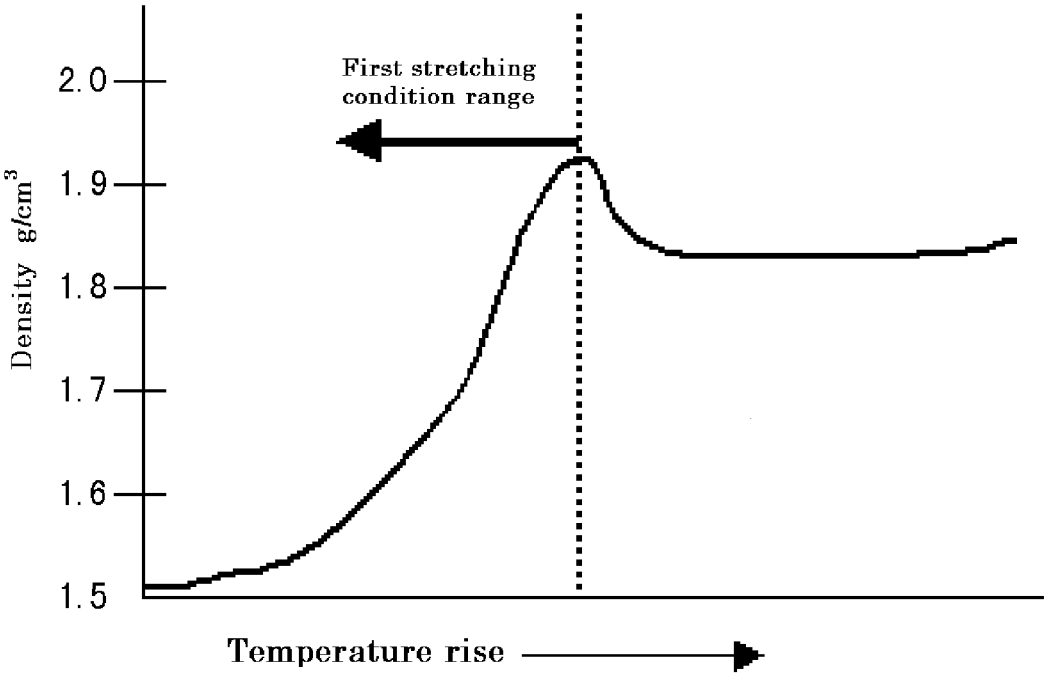
FIG. 6 is a graph showing change in a density of the first-carbonized fiber to temperature increase during the first stretching in the second carbonization step.
Figure 7:
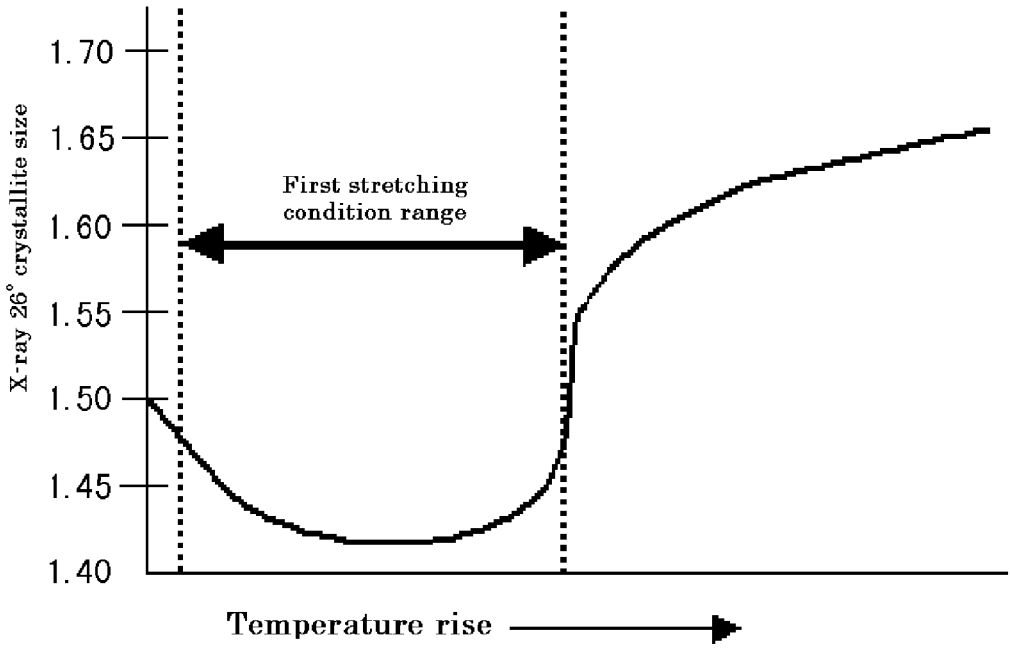
FIG. 7 is a graph showing change in a crystallite size in the first-carbonized fiber to temperature increase during the first stretching in the second carbonization step.

FIGS. 6 and 7 show, as an example, change in a density and a crystallite size as determined by wide-angle X-ray measurement (diffraction angle: 26°), in the first stretching in the second carbonization step for the first-carbonized fibers, respectively.

In the first stretching in the second carbonization step, a fiber tension ("F", in MPa) varies, depending on a fiber diameter, that is, a fiber cross-section area ("S", in $mm^2$) after the first carbonization step. In the present invention, a fiber stress ("B", in mN) is used as a tension factor. This fiber stress is within the range meeting the following formula:

$$1.24>B>0.46$$

wherein $B=F\times S$, $S=\pi D^2/4$, and

D is a diameter of the first-carbonized fiber (mm).

Here, a fiber cross-section area "S" is calculated from a fiber diameter, assuming that the fiber cross section is a perfect circle. A fiber diameter is an average fiber diameter (repeated measurement, n=20) as measured using a micrometer microscope in accordance with JIS-R-7601.

Second Stretching in the Second Carbonization

The first-stretched fibers obtained by the above method undergo the second stretching described below.

In this second stretching, the first-stretched fibers are stretched, during the carbonization, within the temperature-rising range where a density is unchanged or where the density decreases.

Figure 8:
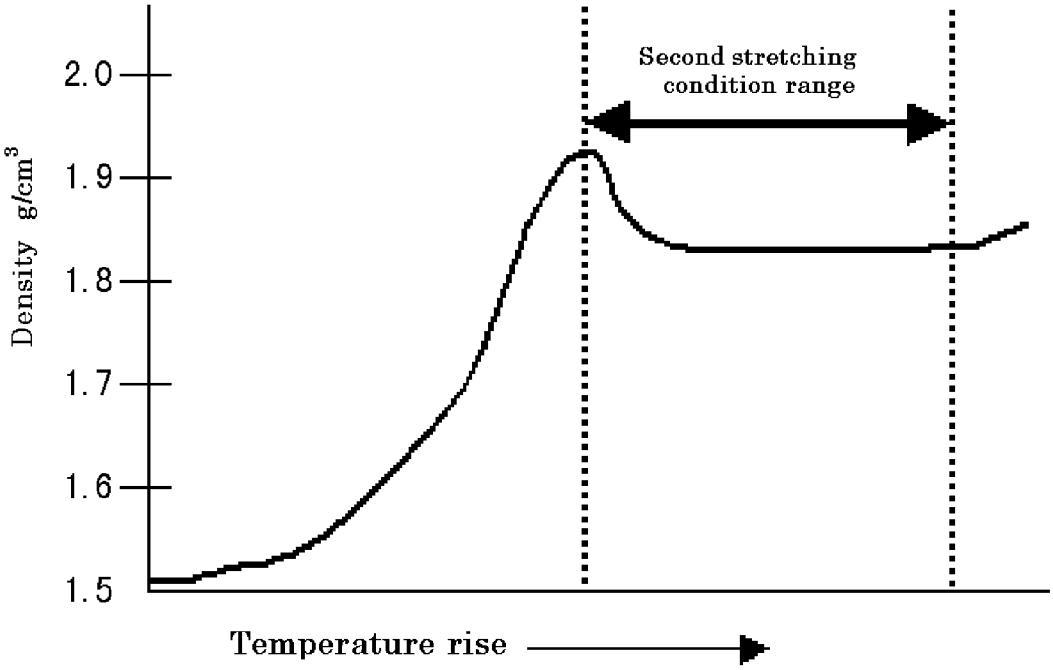
FIG. 8 is a graph showing change in a density of the first-stretched fiber to temperature increase during the second stretching in the second carbonization step.

FIG. 8 shows, as an example, change in a density of the first-stretched fibers in the second stretching and the condition range of the second stretching.

In the second stretching in the second carbonization step, a tension ("H", in MPa) of the fibers being stretched varies, depending on a fiber diameter, that is, a fiber cross-section area ("S", in $mm^2$) after the first carbonization step. In the present invention, a fiber stress ("E", in mN) is used as a tension factor. This fiber stress is within the range meeting the following formula:

$$2.80>E>0.23$$

wherein $E=H\times S$, $S=\pi D^2/4$, and

D is a diameter of the first-carbonized fiber (mm).

A diameter of the second-carbonized fiber is preferably 4.5 to 6.5 μm.

Surface Oxidation

The second-stretched fibers obtained after the second stretching in the second carbonization are electrolyzed to oxidize the fiber surface. The stage number of the surface oxidation is 2 or more, preferably 3 to 10. When the stage is one, oxidation degree of the surface of the carbon fibers obtained significantly varies. Thus, the carbon fibers have an insufficient specific surface area, and therefore, a composite material prepared using the carbon fibers has insufficient strength.

An electrolytic solution used in the surface oxidation has a pH of 0 to 5.5. A oxidation-reduction potential (ORP) is +400 mV or more, preferably +500 mV or more.

A product of the pH value and the ORP value is 0 to 2,300, preferably 0 to 100.

If each of the physical properties of the electrolytic solution departs from the above range, a surface-crease distance, a surface-crease depth, a specific surface area and an elastic modulus of the carbon fibers obtained tend to depart from the ranges of the present invention.

There are no particular restrictions to the electrolytic solution as long as a pH, an ORP and a product of pH and ORP can be adjusted within the above ranges, and an electrolytic solution of an inorganic acid or inorganic acid salt as an electrolyte in water can be used. Particularly preferred examples of an electrolyte include nitric acid, sulfuric acid and hydrochloric acid.

Sizing

The fibers after the surface oxidation are then, if necessary, sized. The sizing can be conducted by a known method. A sizing agent can be appropriately selected, depending on an application. It is preferable to uniformly apply the sizing agent to the fibers and then to dry them.

Winding

The fibers after the above sizing are, if necessary, wound on, for example, a bobbin. The winding can be conducted by a known method. Generally, carbon fibers are wound on, for example, a bobbin under a tension of 9.8 to 29.4 N, and packaged.

The carbon fibers thus obtained have a crease in the fiber surface, so that when being combined with a matrix material to provide a composite material, it exhibits good adhesiveness to the matrix material. These carbon fibers are improved in a resin-impregnated strand strength, a resin-impregnated strand elastic modulus and a density while having little fluff and yarn break.

EXAMPLES

There will be further specifically described the present invention with reference to Examples and Comparative Examples. The processing conditions and the evaluation methods for the physical properties of precursor fibers, oxidized fibers and carbon fibers in Examples and Comparative Examples will be described below.

Density

A density was determined by an Archimedes' method. A sample fiber was degassed in acetone before measurement.

Crystallite Size and Orientation Degree in Wide-angle X-ray Measurement (Diffraction Angle: 17° or 26°)

A X-ray diffractometer (Rigaku Corporation, RINT1200L) and a computer (Hitachi, Ltd., 2050/32) were used. Crystallite sizes at a diffraction angle of 17° and 26° were determined from a diffraction pattern. An orientation degree was determined from a half width.

Entanglement Degree of a Strand

A one-meter strand to be measured was prepared and vertically suspended. A jig which was a 20 g weight with a hook was hooked on the suspended strand and the jig was left naturally dropping. The position at which the jig was hooked was at the center in the strand width direction and 5 cm below from the upper end of the strand. A distance from the hook-on position to the position at which the dropping weight stopped was measured ("A" cm). A strand entanglement degree was determined from the following equation. The measurement number was n=5, and an average of the measured values was calculated as an entanglement degree of the strand.

$$\text{Strand entanglement degree}=100\ \text{cm}/A\ \text{cm}$$

Elastic Modulus of a Single Fiber in the First-stretched Fibers in the First Carbonization Step An elastic modulus of a single fiber in the first-stretched fibers of the first carbonization step was determined in accordance with the method defined in JIS R 7606 (2000).

Strength and Elastic Modulus of Carbon Fibers

Strength and an elastic modulus was determined for the second-carbonized fibers and the third-carbonized fibers (carbon fibers) in accordance with the method defined in JIS R 7601.

Method for Determining the Shape of Carbon Fibers

A difference in height between a peak and a trough (crease depth) can be expressed by a square mean surface roughness. The measuring method is described below.

A carbon fiber sample for evaluation was placed on a stainless-steel disk for measurement, and the carbon fiber was held by both ends. Measurement was conducted for the fixed carbon fiber in Tapping Mode using a scanning probe microscope (DI Company, SPM Nanoscopelll). The data thus obtained were subjected to quadratic curve correction using a bundled software, to determine a square mean surface roughness.

An inter-peak distance (crease distance) was measured using the same scanning probe microscope. Measurement was conducted for a square 2 μm area and the number of creases was determined from the shape image obtained. The measurement was repeated five times, and an average was calculated as a crease distance.

Variation of an Oxidation Degree in a Carbon Fiber Surface

Variation of an oxidation degree in a carbon fiber surface can be determined by cyclic voltammetry. An aqueous solution of phosphoric acid with an electric conductivity of 90 mS/cm was prepared. A reference electrode was an Ag/AgCl electrode, a counter electrode was a platinum electrode having an adequate surface area and a working electrode was a carbon fiber bundle.

A potential scanning range was −0.2 V to 0.8 V, and a potential scanning rate was 5 mV/sec. After three or more sweeping, a potential-current curve was drawn. After confirming that the potential-current curve became stable, a current was read using a potential at +0.4 V to the Ag/AgCl electrode as a reference.

From the following equation, the surface property Ipa of the carbon fiber was calculated.

$$\text{Ipa}(\mu A/cm^2)=\text{Current}(\mu A)/\text{Sample length}(cm)\times[4\pi\cdot\text{basis weight}(g/m)\cdot\text{filament number}/\text{density}(g/cm^3)]^{0.5}$$

Variation in a surface-treatment degree was determined by the following method.

For determining variation in a carbon fiber surface-treatment degree, a carbon fiber strand was divided into two or three strands, each of which was measured an Ipa. Using the measured Ipa value for each divided carbon fiber strand, a proportion of its standard deviation to an average, that is, a C.V. value was determined. The C.V. value was defined as variation in an Ipa.

Specific Surface Area of Carbon Fibers

Using a specific surface area measuring apparatus [a full-automatic gas adsorption measuring apparatus AUTOSORB-1, Yuasa Ionics Inc.], a specific surface area of the carbon fibers was determined. One gram of the carbon fibers was taken and inserted into a jig for conducting measurement. A gas used was krypton gas.

Evaluation Method for Strand Splitting in a Carbon Fiber Strand

Three stainless-steel bars with a diameter of 15 mm (surface roughness: 150 count) were placed in parallel with each other with a distance of 5 cm. A carbon fiber strand was placed on the three stainless-steel bars in a zig-zag manner. While a back tension of 9.8 N was applied, the strand passed over the three stainless-steel bars at 5 m/min. The strand on the stainless-steel bar over which the strand finally passed was observed for 5 min for evaluating the presence of strand splitting.

Evaluation Method for a Carbon Fiber Strand Width

A width of the strand wound on the bobbin with a tension of 9.8 N was directly measured. A strand width was measured in the length direction with the repetition number n=5 (measurement at 5 points/m), and an average of these measured values was defined as a strand width.

Evaluation Method for Dry Fiber after Resin Impregnation

First, a strand strength and a strand elastic modulus were measured in accordance with the method defined in JIS R 7601. Then, a broken-out section of a broken sample after the measurement was observed by SEM (scanning electron microscopy). A fiber without a resin was regarded as dry fiber.

Example 1

A stock spinning solution was ejected through a spinneret having 24,000 holes per spinneret (a spinneret for 24,000 filaments) into an aqueous solution of zinc chloride and solidified to provide a solidified yarn. The stock spinning solution was an acrylic copolymer prepared by polymerizing 95% by weight of acrylonitrile/4% by weight of methyl acrylate/1% by weight of itaconic acid.

This solidified yarn was washed with water, oiled, dried and stretched, and then passed through an interlacing nozzle at a gauge pressure of 50 kPa, to provide a precursor fiber strand having an entanglement degree of 3.5 consisting of 24,000 acrylic precursor fibers having a fiber diameter of 9.0 μm.

This precursor fiber strand was oxidized while being stretched with a stretch ratio of 1.05 in a hot-air circulating oxidation oven with an inlet temperature (minimum temperature) of 230° C. and an outlet temperature (maximum temperature) of 250° C. By the oxidation, an acrylic oxidized fiber strand having a fiber density of 1.36 g/cm$^3$, an entanglement degree of 5 and a fiber diameter of 8.5 μm was prepared. This oxidation step was very stable.

Next, using a first carbonization oven maintained under an inert atmosphere, the oxidized fiber strand was subjected to the first stretching and the second stretching. In the first carbonization oven, an inlet temperature (minimum temperature) was 300° C. and an outlet temperature (maximum temperature) was 800° C.

The first stretching was conduced within the range "β" in FIG. 3 with a stretch ratio of 1.05. The fibers after the first stretching, that is, the first-stretched fibers had a single fiber elastic modulus of 8.8 GPa, a density of 1.40 g/cm$^3$ and a crystallite size of 1.20 nm, and yarn break was not observed.

Then, the first-stretched fibers was subjected to the second stretching in the first carbonization. The conditions of the second stretching was within the temperature range where a density continued to increase and a crystallite size was 1.45 nm or less (FIGS. 4, 5). A stretch ratio was set to 1.00.

Thus, there were provided the first-carbonized fibers having a density of 1.53 g/cm$^3$, an orientation degree of 77.1%, a fiber diameter of 6.8 μm, and a fiber cross-section area of $3.63\times10^{-5}$ mm$^2$ without yarn break.

Then, the first-carbonized fibers were subjected to the first stretching and the second stretching in the second carbonization oven with an inlet temperature (minimum temperature) of 800° C. and an outlet temperature (maximum temperature) of 1,500° C. in an inert atmosphere under the following conditions.

First, the first-carbonized fibers were stretched with a fiber tension of 28.1 MPa and a fiber stress of 1.020 mN within the range of the first stretching as shown in FIGS. 6 and 7 for a density and a crystallite size, to provide first-stretched fibers.

Then, in the second carbonization step, within the temperature range where a density is within the second stretching range shown in FIG. 8, the first-stretched fibers were stretched with a fiber tension of 33.7 MPa and a fiber stress of 1.223 mN, to provide second-carbonized fibers.

Then, the second-carbonized fibers were electrolyzed in an electrolytic solution (an aqueous solution of nitric acid) which had been adjusted to a pH of 0.1, an oxidation-reduction potential (ORP) of +600 mV and a product of the pH and the ORP (=60), for surface oxidation. An electric quantity used for the surface oxidation was 30 C per 1 g of the carbon fibers. The processing stage number was three.

Then, by a known method, a sizing agent was added to the surface-oxidized carbon fiber strand, which was then dried to give a carbon fiber strand.

This carbon fiber strand had a density of 1.77 g/cm$^3$, a fiber diameter of 5.1 μm, a strand strength of 6,030 MPa, a strand elastic modulus of 319 GPa and a density of 1.77 g/cm$^3$.

In the surface of the carbon fibers, there were observed creases with a crease distance of 128 nm, a crease depth of 21 nm, a specific surface area of 1.0 m$^2$/g, variation in an oxidation degree in the surface of 5 (Ipa-CV, in %), and it was a carbon fiber strand with a strand width of 6 mm having good physical properties. There were observed no dry fibers in a compound prepared by impregnating the carbon fibers with a matrix resin and curing the product.

The main data obtained are shown in FIGS. 1 to 3.

Comparative Example 1

Two acrylic precursor fiber strands were prepared as described in Example 1, substituting two parallel spinnerets having 12,000 holes per spinneret (spinneret for 12,000 filaments) for a spinneret for 12,000 filaments. A carbon fiber strand was prepared by the subsequent procedure as described in Example 1, except that the two strands were bundled into one strand during the second carbonization. Bundling of the strands was conducted by getting adjacent strand bundles through one groove on a roller to form a 24,000 filament strand bundle.

In the carbon fiber strand thus prepared, strand splitting was observed by a strand splitting evaluation method as shown in Table 1.

Comparative Example 2

A carbon fiber strand was prepared as described in Comparative Example 1, except that strands were bundled before the first carbonization. The results are shown in Table 1. In the carbon fiber strand thus obtained, strand splitting was observed.

Comparative Example 3

Eight acrylic precursor fiber strands were prepared as described in Example 1, except that eight spinnerets having 3,000 holes per spinneret (spinneret for 3,000 filaments) was used. One carbon fiber strand was prepared by the subsequent procedure as described in Example 1, except that the eight strands were bundled into one strand during the second carbonization.

In the carbon fiber strand thus prepared, strand splitting was observed by a strand splitting evaluation method as shown in Table 1.

Example 2

A carbon fiber strand was prepared as described in Example 1, except that in the interlacing of a precursor fiber strand, a pressurized-air blowing pressure of the interlacing nozzle was 30 kPa as a gauge pressure.

As shown in Tables 2 and 3, all of an entanglement degree of the precursor fiber strand, an entanglement degree of the oxidized fiber strand and stability of the oxidation step were satisfactory.

Comparative Example 4

A carbon fiber strand was prepared as described in Example 1, without a precursor fiber strand being interlaced.

As shown in Tables 2 and 3, an entanglement degree of the precursor fiber strand was 2 and an entanglement degree of the oxidized fiber strand was 4. Due to a low entanglement degree of the precursor strand, the oxidation step was unstable, resulting in many yarn breaks.

Comparative Example 5

A carbon fiber strand was prepared as described in Example 1, except that in the interlacing step, a pressurized-air blowing pressure of the interlacing nozzle was 10 kPa as a gauge pressure.

As shown in Tables 2 and 3, an entanglement degree of the precursor fiber strand was 2 and an entanglement degree of the oxidized fiber strand was 4, and thus, due to instability of the oxidation step, many yarn breaks occurred.

Comparative Example 6

A carbon fiber strand was prepared as described in Example 1, except that in the interlacing step, a pressurized-air blowing pressure of the interlacing nozzle was 70 kPa as a gauge pressure.

As shown in Tables 2 and 3, an entanglement degree of the precursor fiber strand was 5 and an entanglement degree of the oxidized fiber strand was 10. Due to a high entanglement degree, the carbon fiber strand obtained was insufficiently impregnated with a resin, and dry fibers were observed in a test piece after measuring strand strength using this carbon fiber strand.

Example 3

A carbon fiber strand was prepared as described in Example 1, except that the maximum oven temperature in the second carbonization was 1,700° C. and an electric quantity per 1 g of carbon fibers in the surface oxidation of the second-carbonized fibers was 100 C.

As shown in Table 3, the carbon fiber strand thus obtained was satisfactory in all of a carbon fiber strength (CF strength), a carbon fiber elastic modulus (CF elastic modulus), a carbon fiber density (CF density), a crease distance in the surface of the carbon fibers as determined by scanning probe microscope (SPM), a surface crease depth, a specific surface area and variation in an oxidation degree in the surface. No dry fibers were observed.

Example 4

A carbon fiber strand was prepared as described in Example 1, except that the maximum oven temperature in the second carbonization was 1,400° C. and an electric quantity per 1 g of carbon fibers in the surface oxidation of the second-carbonized fibers was 30 C.

As a result, all of a carbon fiber strength (CF strength), a carbon fiber elastic modulus (CF elastic modulus), a carbon fiber density (CF density), a crease distance in the surface of the carbon fibers as determined by scanning probe microscope (SPM), a surface crease depth, a specific surface area and variation in an oxidation degree in the surface were satisfactory as shown in Table 3. The carbon fiber strand had a high strand tensile strength, and no dry fibers were observed.

Comparative Example 7

A carbon fiber strand was prepared as described in Example 1, except that the surface oxidation of the second-carbonized fibers obtained in Example 1 was conducted in one process stage.

As a result, variation in an oxidation degree in the surface of the carbon fibers was large and a carbon-fiber specific surface area and a carbon fiber strength (CF strength) were insufficient as shown in Table 3, and thus, a carbon fiber strand having good physical properties was not obtained.

Comparative Example 8

A carbon fiber strand was prepared as described in Example 1, except that in the surface oxidation of the second-carbonized fibers, an electrolytic solution was an aqueous solution of ammonium sulfate which had been adjusted to a pH of 5.5, a oxidation-reduction potential (ORP) of +300 mV and a product of the pH and the ORP of 1,650.

This carbon fiber strand was insufficient in all of a carbon fiber strength (CF strength), a specific surface area and a surface crease distance as determined for the carbon fibers by scanning probe microscope (SPM) and had an excessive surface crease depth as shown in Table 3, and thus a carbon fiber strand having good physical properties was not obtained.

Comparative Example 9

A carbon fiber strand was prepared as described in Example 1, except that the maximum oven temperature in the second carbonization was 1,350° C. and an electric quantity per 1 g of carbon fibers in the surface oxidation of the second-carbonized fibers was 25 C.

This carbon fiber strand was insufficient in all of a carbon fiber elastic modulus (CF elastic modulus), a specific surface area and a surface crease distance as determined for the carbon fibers by scanning probe microscope (SPM) as shown in Table 3, and thus a carbon fiber strand having good physical properties was not obtained.

Comparative Example 10

A carbon fiber strand was prepared as described in Example 1, except that in the stretching in the first carbonization, the first stretching was conducted, but the second stretching was not conducted.

The carbon fiber strand thus obtained had insufficient carbon fiber strength (CF strength) as shown in Table 3, and thus a carbon fiber strand having good physical properties was not obtained.

Comparative Example 11

A carbon fiber strand was prepared as described in Example 1, except that the stretching in the first carbonization was comprised of the second stretching and the first stretching was not conducted.

A carbon fiber strength (CF strength) was inadequate as shown in Table 3, and thus a carbon fiber strand having good physical properties was not obtained.

TABLE 1

| | Filament number (spinneret number) | Strand bundling position | Carbon fiber strand width | Strand splitting |
|---|---|---|---|---|
| Example 1 | 24000H (single) | — | 6 mm | Not observed |
| Comparative Example 1 | 12000H (two) | During carbonization | 7 mm | Observed |
| Comparative Example 2 | 12000H (two) | Before carbonization | 7 mm | Observed |
| Comparative Example 3 | 3000H (eight) | During carbonization | 8 mm | Observed |

TABLE 2

| | Interlacing | Pressure (kPa) | Precursor entanglement degree | Stability of an oxidation step | Entanglement degree of oxidized fibers | Carbon fiber strand width | Dry fiber in a test piece after strand strength measurement |
|---|---|---|---|---|---|---|---|
| Comparative Example 4 | Not done | — | 2 | Low | 4 | 7.5 mm | Not observed |
| Example 2 | Done | 30 | 3 | High | 5 | 7 mm | Not observed |
| Example 1 | Done | 50 | 3.5 | High | 6 | 6 mm | Not observed |
| Comparative Example 5 | Done | 10 | 2 | Low | 4 | 7.5 mm | Not observed |
| Comparative Example 6 | Done | 70 | 5 | High | 10 | 5 mm | Observed |

TABLE 3

| | Stretching in the first carbonization | Tension control in the second carbonization | Maximum temperature (° C.) | Surface-treating agent | pH | ORP | pH × ORP | Surface oxidation: Process stage number | Surface oxidation: Electric quantity (C/g) |
|---|---|---|---|---|---|---|---|---|---|
| Example 1 | First + second | Second | 1500 | Nitric acid | 0.1 | +600 | 60 | 3 | 50 |
| Example 3 | First + second | Second | 1700 | Nitric acid | 0.1 | +600 | 60 | 3 | 100 |
| Example 4 | First + second | Second | 1400 | Nitric acid | 0.1 | +600 | 60 | 3 | 30 |
| Comparative Example 7 | First + second | Second | 1500 | Nitric acid | 0.1 | +600 | 60 | 1 | 50 |
| Comparative Example 8 | First + second | Second | 1500 | Ammonium sulfate | 5.5 | +300 | 1650 | 3 | 50 |
| Comparative Example 9 | First + second | Second | 1350 | Nitric acid | 0.1 | +600 | 60 | 3 | 25 |
| Comparative Example 10 | First alone | Second | 1500 | Nitric acid | 0.1 | +600 | 60 | 3 | 50 |
| Comparative Example 11 | Second alone | Second | 1500 | Nitric acid | 0.1 | +600 | 60 | 3 | 50 |

TABLE 4

| | CF strand strength (MPa) | CF strand elastic modulus (GPa) | CF density ($g/cm^3$) | Surface-treatment variation (Ipa CV, in %) | Crease distance (nm SPM) | Crease depth (nm SPM) | Specific surface area ($m^2/g$) |
|---|---|---|---|---|---|---|---|
| Example 1 | 6030 | 319 | 1.77 | 5 | 128 | 21 | 1 |
| Example 3 | 5980 | 338 | 1.76 | 7 | 131 | 20 | 1.3 |
| Example 4 | 6080 | 310 | 1.78 | 5 | 120 | 19 | 0.9 |
| Comparative Example 7 | 5880 | 318 | 1.77 | 9 | 120 | 22 | 0.85 |
| Comparative Example 8 | 5730 | 319 | 1.77 | 5 | 115 | 25 | 0.66 |
| Comparative Example 9 | 6320 | 294 | 1.8 | 6 | 105 | 19 | 0.8 |
| Comparative Example 10 | 5880 | 319 | 1.77 | 5 | 127 | 21 | 1.1 |
| Comparative Example 11 | 5730 | 319 | 1.76 | 5 | 126 | 21 | 1 |

CF: carbon fiber

The invention claimed is:

1. A carbon fiber strand comprising a bundle of 20,000 to 30,000 carbon fibers, each of which has in the surface thereof, a plurality of creases parallel to the fiber-axis direction of the carbon fiber and in which as measured by scanning probe microscopy, an inter-crease distance in the surface of said carbon fiber is 120 to 160 nm, a crease depth in the surface is 12 to less than 23 nm, an average fiber diameter is 4.5 to 6.5 μm, a specific surface area is 0.9 to 2.3 $m^2/g$ and a density is 1.76 $g/cm^3$ or more, wherein said carbon strand has a strand tensile strength of 5,900 MPa or more and a strand tensile modulus of 300 GPa or more; a strand wound on a bobbin with a tension of 9.8 N has a strand width of 5.5 mm or more; and no strand splittings are observed in a strand splitting evaluation method where a running carbon fiber strand with a tension of 9.8 N passes through three stainless-steel rods.

2. A process for producing the carbon fiber strand as claimed in claim 1, comprising passing a solidified-yarn strand prepared by spinning a stock spinning solution using a spinneret having 20,000 to 30,000 spinning holes through an interlacing nozzle at a pressurized-air blowing pressure of 20 to 60 kPa as a gauge pressure to provide a precursor fiber strand; then oxidizing said precursor fiber strand in hot air at 200 to 280° C. to provide an oxidized fiber strand; conducting first carbonization by stretching said oxidized fiber strand with a first stretch ratio of 1.03 to 1.06 at a temperature of 300 to 900° C. in an inert-gas atmosphere and then with a second stretch ratio of 0.9 to 1.01; then, conducting second carbonization at a temperature of 1,360 to 2,100° C. in an inert-gas atmosphere; and then, oxidizing twice or more the surface of the carbon fiber strand obtained after said carbonization, by electrolytic oxidation in an electrolytic solution with a pH of 0 to 5.5, a oxidation-reduction potential of +400 mV or more and a product of a pH and a oxidation-reduction potential of 0 to 2,300.

3. The process for producing a carbon fiber strand as claimed in claim 2, wherein said stock spinning solution is an aqueous solution of zinc chloride or a solution of an acrylic polymer in an organic solvent.

* * * * *